US007553167B2

(12) United States Patent
Zhang et al.

(10) Patent No.: US 7,553,167 B2
(45) Date of Patent: Jun. 30, 2009

(54) CABLE CONNECTOR

(75) Inventors: Ming Zhang, Kunshan (CN); Biao-Bing Lv, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/900,668

(22) Filed: Sep. 13, 2007

(65) Prior Publication Data

US 2008/0064263 A1 Mar. 13, 2008

(30) Foreign Application Priority Data

Sep. 13, 2006 (CN) ..... 2006 2 0076594 U

(51) Int. Cl.
*H01R 12/00* (2006.01)

(52) U.S. Cl. ..... 439/74; 439/497; 439/597

(58) Field of Classification Search ..... 439/74, 439/497, 579

See application file for complete search history.

(56) References Cited

U.S. PATENT DOCUMENTS 6,830,478 B1 * 12/2004 Ko ..... 439/579

FOREIGN PATENT DOCUMENTS

JP 2000-331731 11/2000

* cited by examiner

*Primary Examiner*—Truc T Nguyen
(74) *Attorney, Agent, or Firm*—Wei Te Chung

(57) ABSTRACT

A cable connector includes a first connector and a second connector. The first connector comprises a first housing defining a receiving space for receiving the second connector, and a plurality of contacts assembled to the first housing, each having a contacting arm exposed in the receiving space and an engaging arm disposed on a top surface of the first housing for being soldered with cables easily. The second connector comprises a second housing received in the receiving space of the first housing and a plurality of terminal received in the second housing for electrically contacting with the contacting arms of the contacts of the first connector.

19 Claims, 8 Drawing Sheets

CABLE CONNECTOR

BACKGROUND OF THE INVENTION

1. Field of the Invention

The present invention relates to a cable connector for electrically connecting cables to a print circuit board.

2. Description of Related Art

Following development of electronic and communication technology, more and more different connectors are widely used for connecting electronic equipments, such as a cable connector, which is used for connecting cables to a print circuit board and builds signal transmission path between the cable and the print circuit board.

JP. Patent Application publication No. 2000-331731 discloses such a cable connector, which comprises a first connector connecting with a plurality of cables, and a second connector assembled to a print circuit board. The first connector has a first housing, a plurality of power contacts and signal contacts received in the first housing and each having a U-shaped contacting portion with an opening mouth, and a pressing plate having a haulm for pressing the cables to the U-shaped contacting portions. The cables are transversely disposed upon the mouths of the first and the second contacts, then the pressing plate press the cables downwardly toward bottoms of the mouths to make each of the cables form a U-shaped ends, whose opposed legs abut against and electrically contact with corresponding opposed inner sides of a corresponding mouth. The second connector has a second housing and a plurality of third contacts for electrically connecting with the first and the second contacts. The first connector engages with the second connector to electrically connect the cables to the print circuit board.

However, the pressing plate is an accessory component, which may cause increased cost and complex manufacture process. And when the pressing plate presses the cables downwardly, the sidewall of the first housing will also be indirectly pressed that may destroy the sidewall, on the otherwise, for the mouth of the contacts are used for receiving the cables, no plastic fills there, so the intensity of the first housing is not enough.

Hence, an improved cable connector is required to overcome the disadvantages of the prior art.

SUMMARY OF THE INVENTION

An object of the present invention is to provide a cable connector in which the cables reliably electrically connects with contacts.

Accordingly, to achieve above-mentioned object, a cable connector of present invention includes a first connector comprising a first housing and a plurality of contacts assembled to the first housing, and a second connector comprising a second housing and a plurality of terminal received in the second housing. The first housing defines a receiving space recessed from a bottom surface thereof and a plurality of holes extending downwardly from a top surface thereof and communicating with the receiving space. Each contact has a contacting arm received in the holes and exposed in the receiving space and an engaging arm being disposed on a top surface of the first housing for being soldered with a cable easily. The second housing is accepted in the receiving space of the first housing, and the terminals of the second connector are electrically contacting with the contacting arms of the contacts of the first connector.

Other objects, advantages and novel features of the present invention will become more apparent from the following detailed description of the present embodiment when taken in conjunction with the accompanying drawings.

DETAILED DESCRIPTION OF THE INVENTION

Reference will now be made in detail to the preferred embodiment of the present invention.

Figure 1:
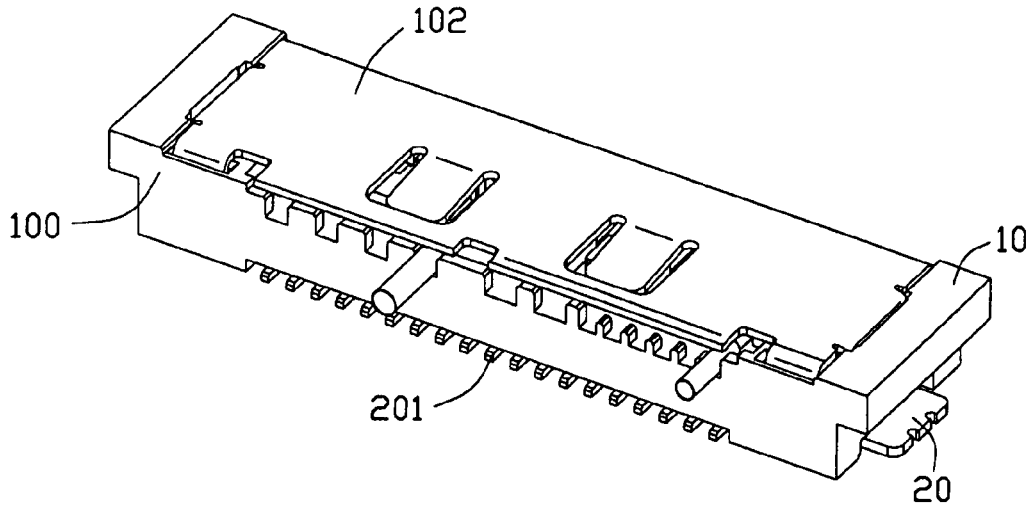
FIG. 1 is a perspective view of a cable connector of the present invention.
Figure 2:
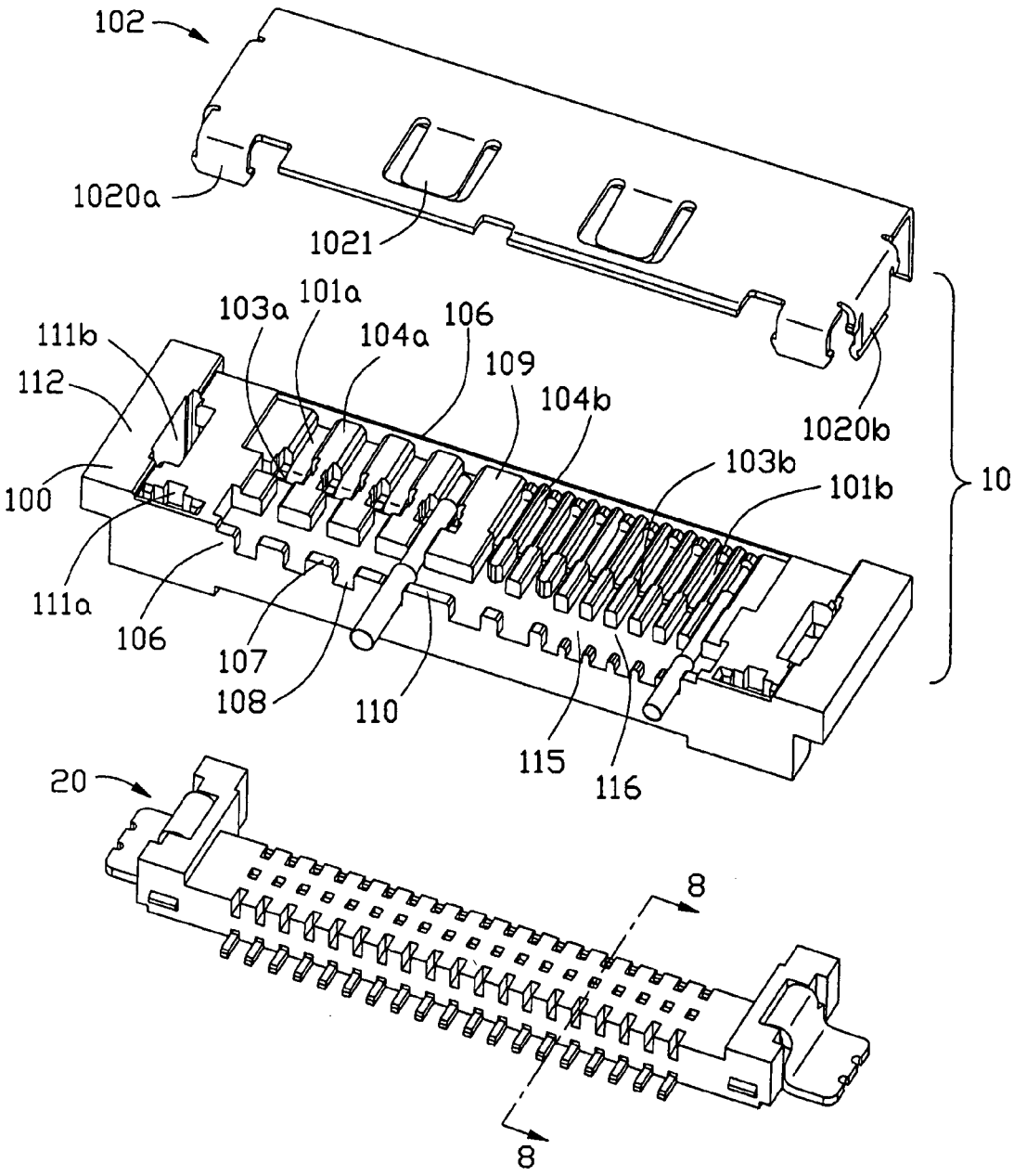
FIG. 2 is a partially exposed, perspective view of the cable connector of the present invention.
Figure 3:
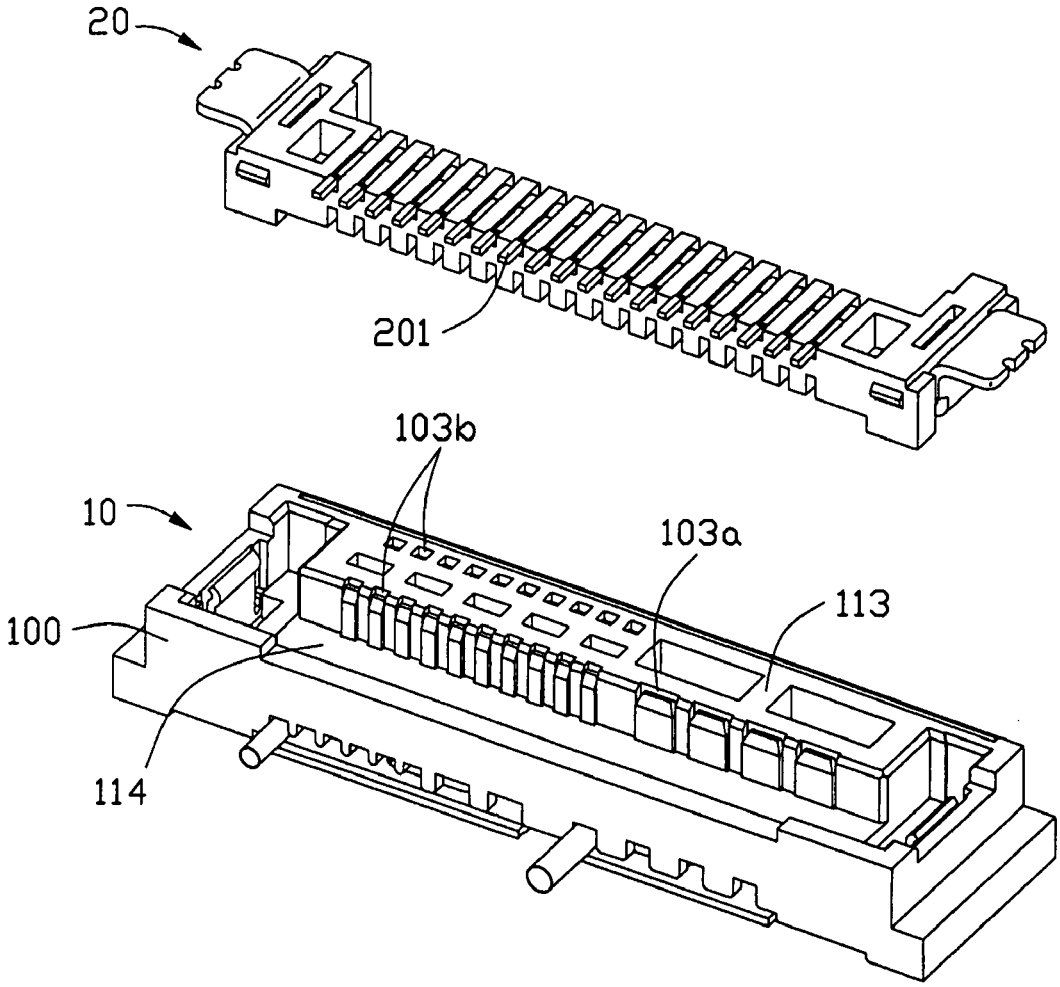
FIG. 3 is an assembled, perspective view of a first connector and a second connector the cable connector, taken from a bottom side.

Referring to FIGS. 1-3, the cable connector in accordance with the present invention is used to connect cables (not labeled) to a print circuit board (not shown). The cable connector comprises a first connector 10 and a second connector 20. The first connector 10 has a first housing 100 defining a U-shaped receiving space 114 for the second connector 20, a plurality of power contacts 101*a* and signal contacts 101*b* and a shell 102 covering the first housing. The second connector 20 has a second housing 200 and a plurality of terminals 201 received in the housing 200 for electrically connecting with the power and the signal contacts 101*a*, 101*b*.

Figure 4:
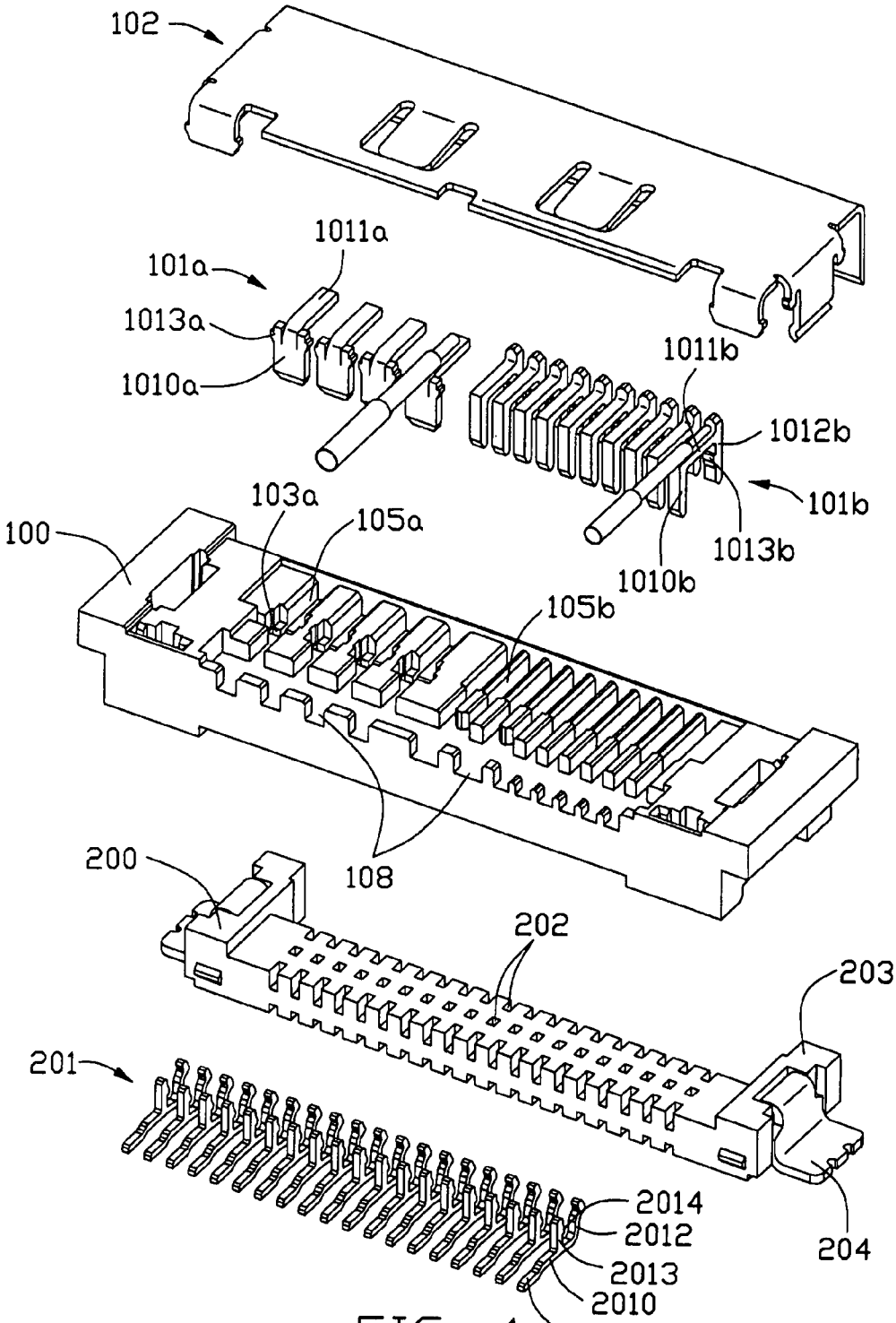
FIG. 4 is an exploded, perspective view of the cable connector of the present invention.
Figure 5:
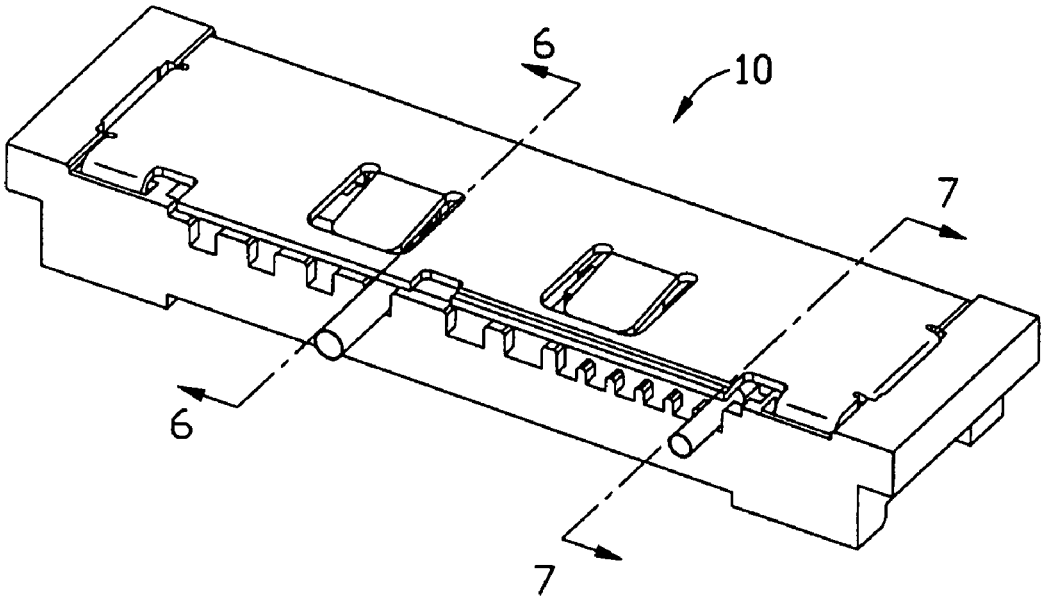
FIG. 5 is a perspective view of the first connector of the cable connector.
Figure 6:
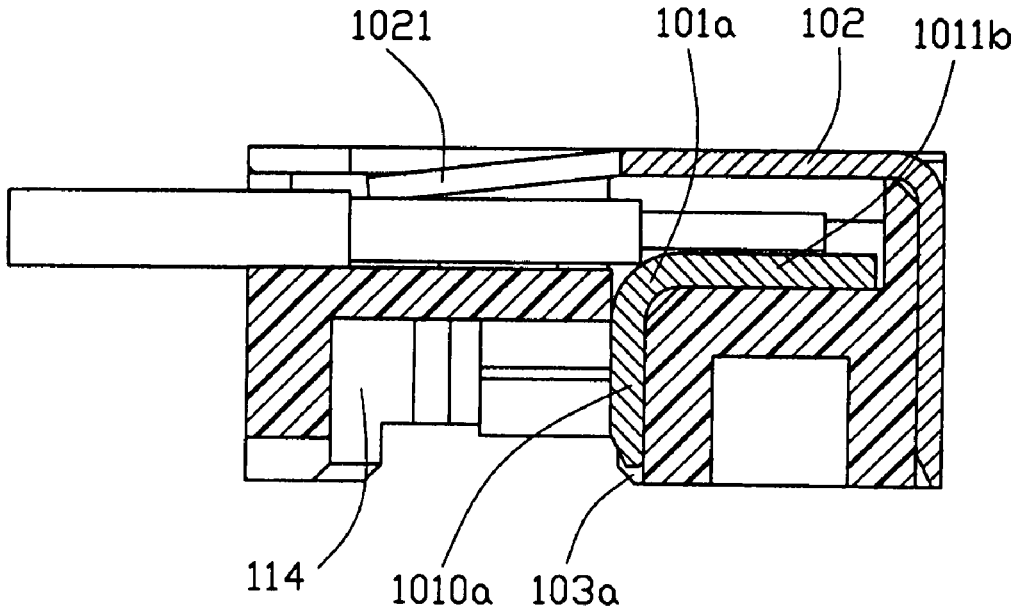
FIG. 6 is a cross-sectional view of the first connector taken along line 6-6 of FIG. 5.
Figure 7:
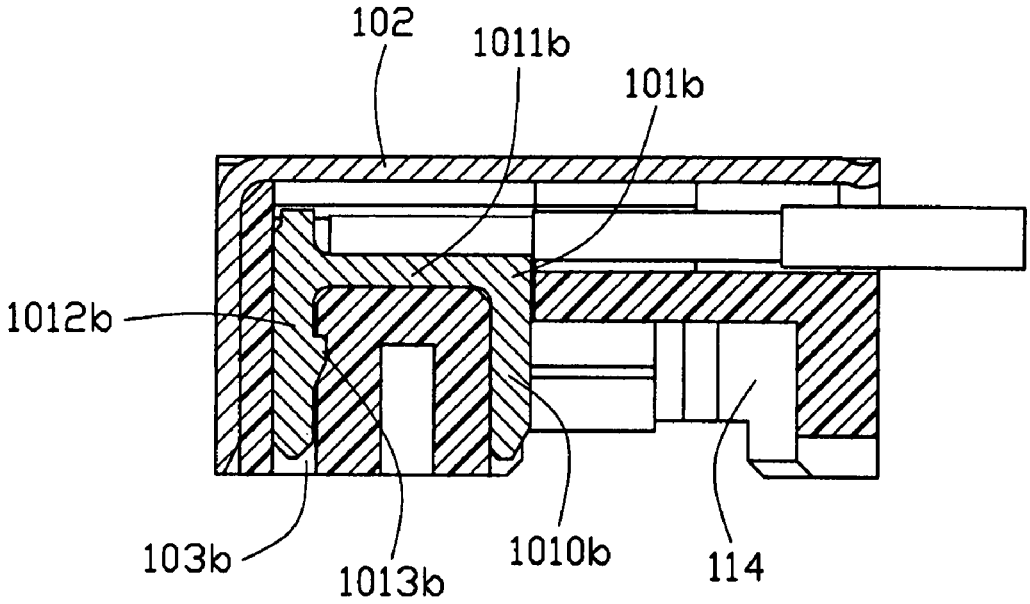
FIG. 7 is a cross-sectional view of the first connector taken along line 7-7 of FIG. 5.

Referring to FIGS. 2-5, conjoint with FIG. 6-7, the first housing 100 is a longitudinal body and has two lateral ends 112, a front and a rear sidewall 106 and an approximately rectangular main body 115 surrounded by the ends 112 and sidewalls 106. A protruding bar 109 is disposed in a center part of the main body 115 and divided the main body 115 into two a right part and a left part.

The left part of the main body 115 is formed with a plurality of parallel ribs 104*a* on a top surface 116 thereof which are linked with the front sidewall 106, a plurality of slots 105*a* defined by two adjacent ribs 104*a*, and a plurality of first through hole 103*a* (referring to FIG. 6) extending downwardly from a part of each slots 104*a* and through the first housing 100 in a vertical direction for accommodating the power contacts 101*a*. The right part of the main body 115 is formed with a plurality of parallel ribs 104*b* on the top surface 116 which is narrower than the rids 104*a* and also linked with the front sidewall 106, a plurality of slots 105*b* defined by two adjacent ribs 104*b*, and a plurality of second through hole 103*b* (referring to FIG. 7), which are arranged in a front and a rear row and respectively downwardly extending from the slots 105*b* through the first housing 100 in a vertical direction for retaining the signal contacts 101*b*.

All of the protruding bar 109 and ribs 104*a*, 104*b* are extending along a front-to-back direction. The rear sidewall 106 is formed by a plurality of pieces 107 protruding from a rear edge of the top surface 116 of the main body 115, and two adjacent pieces 107 define a gaps 108 therebetween, respectively aligned with a corresponding slot 105*a* or slot 105*b* for setting the cables. Each end 112 is provides with two latching holes 111*a*, 111*b* respective in an outside and a rear side thereof. Referring to FIG. 3, which shows a bottom view of the first connector 10, the first housing 100 defines the U-shaped receiving space 114 recessed from a rear side of a bottom surface 113 thereof. Bottom parts of the first through holes 103*a* and the second through holes 103*b* in a rear line communicate with the receiving space 114 for exposing the power and signal contacts 101*a*, 101*b* in the receiving space 114.

referring to FIG. 4, the power contact 101*a* is approximately in an L-shaped, each has a vertical contacting arm 1010*a* with stabs 1013*a* on two lateral sides used for retaining the power contact 101*a* to the first through hole 103*a*, and an engaging arm 1011*a* forwardly and horizontally extending from a top end of the contacting arm 1010*a*. When assembly, the power contacts 101*a* are downwardly assembled to the first housing 100, in a manner that the contacting arms 1010*a* insert into correspond first through holes 103*a*, and the engaging arms 1011*a* are disposed in the slots 105*a*.

The signal contact 101*b* is approximately in a U-shaped, each has a vertical contacting arm 1010*b*, a vertical retaining arm 1012*b* with stabs 1013*b* and a horizontal engaging arm 1011*b* linking top ends of the contacting arm 1010*b* and the retaining arm 1012*b*. When assembly, the second contacts 101*b* are downwardly assembled to the first housing 100, in a manner that the contacting arms 1010*b* and retaining arms 1012*b* respectively insert into the rear and the front second through holes 103*b*, and the engaging arms 1011*b* are disposed in the slots 105*b*. Furthermore, the front of each engaging arm 1010*b* has a projecting portion (not labeled), on which the cables depend.

The shell 102 is stamped from a metal piece, and has a pair of latching arms 1020*a*, 1020*b* on opposed ends thereof. When assembly, the shell 102 covers the top surface 116 and a front surface of the first housing 100, the latching arms 1020*a*, 1020*b* insert into and engage with the corresponding latching holes 111*a*, 112*b* to retain the shell 102 to the first housing 100. Furthermore, two pressing piece 1021 are formed on a top of the shell 102 for pressing the cables. Referring to FIG. 5, it should be noted that the shell 102 assembles to the first housing 100, after the cables electrically connect to the power and the signal contacts 101*a*, 101*b*, which are already mounted on the first housing 100.

Here, we will describe the process of the cable assembling to the first housing, the cables have a plurality of power cables to be seated in the left part of the main body 115, and a plurality of signal cables to be seated in the right part of the main body 115. Since each of the slots 105*a*, 105*b* is aligned with a gaps 108 defined on the front sidewall 106, the power cables are respectively disposed in the slots 105*a* and corresponding gaps 108, the signal cables are respectively disposed in the slots 105*b* and corresponding gaps 108. Cable cores in a front end of the cables are respectively located upon the engaging arms 1011*a*, 1011*b* of the power and the signal contacts 101*a*, 101*b*, then solder the cable cores to the engaging arms 1011*a*, 1011*b* to establish an electrical transmission path between the cables and the first connector 10.

Figure 8:
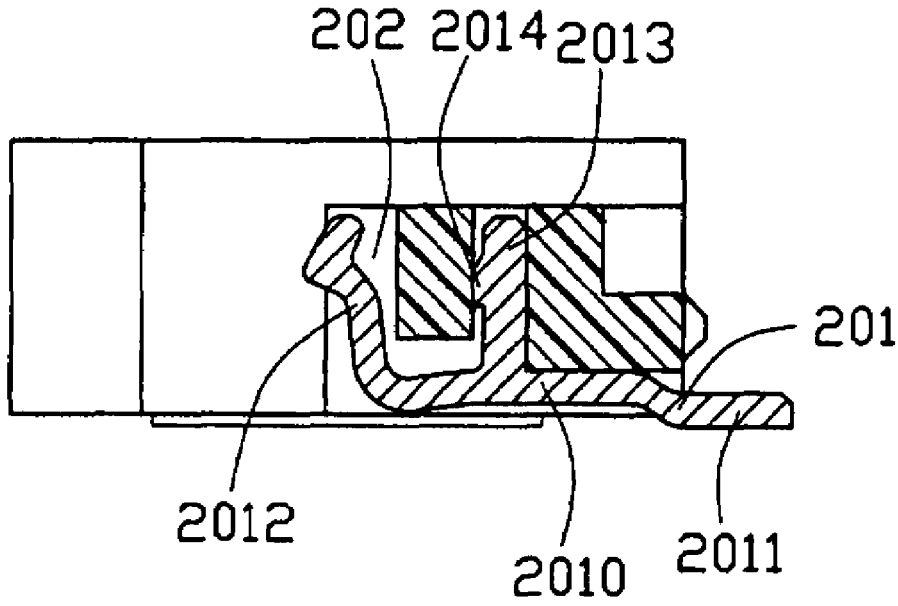
FIG. 8 is a cross-sectional view of the cable connector taken along line 8-8 of FIG. 2.

Referring to FIGS. 3, 4 and 8, The second connector 20 comprises a U-shaped second housing 200 having an elongated body with a plurality of groove 202, two ends 203 extending forwardly beyond the main body and each assembling a soldering pad 204 on an outside surface thereof, and a plurality of terminals 201 received in the groove 202. The terminals 201 comprises a contact portion 2012 exposed out of a front surface of the second housing 200, a vertical retaining portion 2013 with stabs 2014 and a horizontal portion 2010 linking the contact portion 2012 and the retaining portion 2013 and extending rearward beyond the second housing 200 with a tail 2011 for being soldered to a print circuit board (not shown). Conjoint with FIG. 1, the second housing 200 of the second connector 20 is completely received in the receiving space 114 of the first connector 10, the soldering pads 204 laterally extend out. The contact portions 2012 of the terminals 201 respectively abut against and electrically contact with the contacting arms 1010*a*, 1010*b* of the power and the signal contacts 101*a*, 101*b* exposed in the receiving space 114 (referring to FIG. 6-8).

While a preferred embodiment in accordance with the present invention has been shown and described, equivalent modifications and changes known to persons skilled in the art according to the spirit of the present invention are considered within the scope of the present invention as described in the appended claims.

What is claimed is:

1. A cable connector comprising:

a housing defining a receiving space recessed from a front part of a bottom surface thereof and a plurality of holes extending downwardly from a top surface thereof and communicating with the receiving space, the housing further having a plurality of channels downwardly extending from a rear part of a top surface thereof and being separated from the receiving space; and a plurality of contacts assembled to the housing, each contact having a contacting arm received in the hole and exposed in the receiving space and an engaging arm disposed on a top surface of the first housing the contact further having a retaining arm inserting into and engaging with the channel to retain the contact in the housing;

wherein the housing is formed with a plurality of parallel ribs on the top surface thereof and a plurality of slots respectively defined by every two adjacent ribs, the engaging arms of the contacts are located in the slots, the holes of the housing extend downwardly from each slots, the contacting arm of each contact extends downwardly from the engaging portion into the holes to be exposed in the receiving space.

2. The cable connector as described in claim 1, wherein the housing is cubical shape, the channels downwardly pass through a part of the bottom surface of the housing where the receiving space is not recessed from.

3. The cable connector as described in claim 1, wherein the housing is formed with plurality of gaps in a rear side thereof, the gaps are respectively aligned with corresponding slots to regularly arrange the cables together with the slots.

4. The cable connector as described in claim 1, further comprises a shell assembled to and covering the housing, the housing defines at least one latching hole on two lateral ends thereof, and the shell is formed with at least one latching arm engaging with the latching hole of the housing and at least on pressing piece on a top thereof for pressing the cables.

5. The cable connector as described in claim 1, wherein the contacts include a plurality of power contacts and a plurality of signal contacts.

6. The cable connector as described in claim 5, wherein the power contact is in an L-shaped, the engaging arm extends forwardly and horizontally from a top of the contact arm, which is upright.

7. The cable connector as described in claim 5, wherein the retaining arm of the signal contact is in parallel to the contacting arm, the engaging arm extends horizontally and links tops of the contact arm and the retaining arm.

8. A cable connector comprising:

a first connector comprising a first housing and a plurality of contacts assembled to the first housing, the first housing defining a receiving space recessed from a bottom surface thereof and a plurality of holes extending downwardly from a top surface thereof and communicating with the receiving space, each contact having a contacting arm received in the holes and exposed in the receiving space and an engaging arm disposed on a top surface of the first housing; and a second connector comprising a second housing received in the receiving space of the first housing and a plurality of terminals receiving in the second housing for electrically contacting with the contacting arms of the contacts of the first connector, the second housing being in a U-shaped and having an elongated body with a plurality of grooves receiving the terminals, two ends extending forwardly beyond the elongated body;

wherein the housing is formed with a plurality of parallel ribs on the top surface thereof and a plurality of slots respectively defined by every two adjacent ribs, the engaging arms of the contacts are located in the slots, the holes of the housing extend downwardly from each slots, the contacting arm of each contact extends downwardly from the engaging portion into the holes to be exposed in the receiving space.

9. The cable connector as described in claim 8, wherein the first housing is formed with a plurality of parallel ribs on the top surface thereof and a plurality of slots respectively defined by two adjacent ribs, the engaging arms are located in the slots.

10. The cable connector as described in claim 9, wherein the holes of the first housing extend downwardly from each slots, and the contacting arm extends downwardly from corresponding engaging portion to insert into the hole and be exposed in the receiving space.

11. The cable connector as described in claim 10, wherein the first housing is formed with a plurality of gaps in a rear side thereof, the gaps are aligned with the slots to regularly arrange the cables together with the slots.

12. The cable connector as described in claim 11, wherein the terminal of second connector has a contact portion exposed out of a front surface of the second housing, a vertical retaining portion and a horizon portion linking the contact portion and the retaining portion and extending rearward beyond the second housing with a tail for being soldered to a printed circuit board.

13. The cable connector as described in claim 10, wherein the receiving space of the first housing is a U-shaped space to receive the U-shaped second housing.

14. The cable connector as described in claim 9, wherein the contacts include a plurality of power contacts and a plurality of signal contacts, the first housing of the first connector has a plurality of channels downwardly extending from a top surface thereof and separated from the receiving space.

15. The cable connector as described in claim 14, wherein the power contact is in an L-shaped, the engaging arm extends forwardly and horizontally from a top of the contact arm, which is upright.

16. The cable connector as described in claim 15, wherein the signal contact is in a U-shaped and further comprises a retaining arm parallel to the contacting arm to retain the signal contact to the housing, the engaging arm extends horizontally and links tops of the contact arm and the retaining arm.

17. A connector assembly comprising:

a board mount connector including:

an insulative first housing extending along a lengthwise direction and defining a first mating portion on one longitudinal side in a first face;

a plurality of first contacts disposed in the first housing with first contacting sections exposed to the first mating portion and with first soldering sections exposed to a first mounting area which is located on the other longitudinal side in a second face opposite to said first face; and a plurality of wires extending into the first housing from said longitudinal side to the other longitudinal side with inner conductors soldered to the corresponding first soldering sections, wherein the first contacting section is located closer to said longitudinal side than the first soldering section to said longitudinal side, and the first mating portion is closer to said longitudinal side than to said other longitudinal side;

wherein the housing defining a receiving space recessed from a front part of a bottom surface thereof; and wherein the first housing defining a receiving space recessed from a bottom surface thereof and a plurality of holes extending downwardly from a top surface thereof and communicating with the receiving space, each contact having a contacting arm received in the holes and exposed in the receiving space and an engaging arm disposed on a top surface of the first housing; and wherein the housing is formed with a plurality of parallel ribs on the top surface thereof and a plurality of slots respectively defined by every two adjacent ribs, the engaging arms of the contacts are located in the slots, the holes of the housing extend downwardly from each slots, the contacting arm of each contact extends downwardly from the engaging portion into the holes to be exposed in the receiving space.

18. The connector assembly as claimed in claim 17, further including a second connector comprising an insulative second housing extending along said lengthwise direction and defining a second mating portion on one longitudinal side which is coupled to the first mating portion under a condition that said second connector is equipped with a plurality of second contacts with second contacting sections located around the second mating portion and mated with the corresponding first contacting sections of the first contacts.

19. The connector assembly as claimed in claim 18, wherein said second connector is with a pair of soldering pads at two opposite lengthwise ends for soldering to a printed circuit board under a condition that both said soldering pads arc essentially aligned with a lengthwise center line of the housing instead of being offset on one side.

* * * * *